US006585090B2

(12) United States Patent
Harvey

(10) Patent No.: US 6,585,090 B2
(45) Date of Patent: Jul. 1, 2003

(54) STACKABLE INTERLOCKING CARRYING CASE FOR A PORTABLE COMPUTER

(76) Inventor: Stephen C. Harvey, 480 N. 17th St., Las Cruces, NM (US) 88005

( * ) Notice: Subject to any disclaimer, the term of this patent is extended or adjusted under 35 U.S.C. 154(b) by 0 days.

(21) Appl. No.: 10/044,881

(22) Filed: Oct. 26, 2001

(65) Prior Publication Data

US 2003/0079949 A1 May 1, 2003

(51) Int. Cl.[7] ..... A45C 5/00; A45C 13/00; A45C 3/00

(52) U.S. Cl. ..... 190/108; 190/18 A; 190/115; 206/504; 206/509; 206/510; 206/511; 220/23.4

(58) Field of Search ..... 190/39, 108, 18 A, 190/115; 16/48, 113.1; 206/508, 504, 509, 510, 511, 512; 220/23.6, 23.4

(56) References Cited

U.S. PATENT DOCUMENTS 4,066,155 A * 1/1978 Buchek ..... 190/3
4,813,542 A * 3/1989 Thompson et al. ..... 190/37 X
5,099,968 A * 3/1992 Kikuchi ..... 190/108
5,564,805 A * 10/1996 Dickinson ..... 206/508 X
5,906,291 A * 5/1999 Mann et al. ..... 190/39 X
D439,739 S * 4/2001 Murphy ..... D3/272
2002/0096844 A1 * 7/2002 Clegg ..... 280/47.17

* cited by examiner

*Primary Examiner*—Tri M. Mai
(74) *Attorney, Agent, or Firm*—Morland C. Fischer

(57) ABSTRACT

A shock resistant carrying case in which to transport fragile equipment (e.g. a portable computer) having a body that is configured to facilitate a stable, close together stacking of a plurality of such carrying cases side-by-side and one above the other in an array of rows and columns that is suitable for storage and/or shipment. The carrying case has a pair of wheels located at one end of a base thereof and a pair of locking feet projecting from the opposite end of the base. The carrying case also has a first pair of interlocking cavities formed in one end of a lid thereof and a second pair of interlocking cavities formed in the opposite end of the lid. The pair of wheels and the pair of locking feet from the base of a first carrying case are received within respective ones of the first and second pairs of interlocking cavities formed in the lid of an adjacently positioned carrying case, whereby the first and adjacent carrying cases are held in face-to-face interlocking engagement with one another.

4 Claims, 4 Drawing Sheets

STACKABLE INTERLOCKING CARRYING CASE FOR A PORTABLE COMPUTER

BACKGROUND OF THE INVENTION

1. Field of the Invention

This invention relates to a shock resistant carrying case in which to transport fragile equipment, such as a portable computer, or the like. The carrying case has a body that is configured to facilitate a stable, close together stacking of a plurality of such carrying cases in an array of rows and columns that is suitable for storage and/or shipment.

2. Background Art

With the advent of portable computers, it has become desirable to be able to safely transport such computers from place-to-place while avoiding possible damage caused by shock and other mechanical forces to which the computer may be subjected during transport. Accordingly, portable computers have now been enclosed within shock resistant cases that are capable of preventing the transfer of impact forces to the computer.

However, it sometimes becomes necessary to transport or place into storage large numbers of shock resistant portable computer carrying cases. For example, the military may wish to ship a large supply of portable computers to a rugged, distant location to monitor and control a military exercise. In another case, a government agency may wish to ship a supply of portable computers to an inhospitable environment at which tests are to be conducted and recorded. Because of the relatively large size of the conventional shock resistant computer carrying cases, it is often difficult to stack a large number of such carrying cases close together so as to easily fit in the cargo hold of a truck, plane or ship, particularly when storage space is at a premium.

What is more, the carrying cases arranged in a stack have been known to shift or slide over top one another as the vehicle in which the carrying cases are transported is exposed to turbulence, steep inclines and declines, and sharp turns. Consequently, a relatively high stack of carrying cases has been known to tumble and fall over.

What would be desirable is a means by which a plurality of carrying cases in which portable computers and other fragile equipment are transported can be stacked side-by-side and one on top of the other in an efficient, close together array so as to maximize stability and minimize space consumption.

SUMMARY OF THE INVENTION

In general terms, a stackable interlocking carrying case is disclosed in which to transport a portable computer or other fragile equipment. The carrying case includes a rugged, shock resistant body having a lid pivotally attached to a base. A pair of wheels is rotatably coupled to the carrying case at one end of the base. A pair of locking feet project from the carrying case at opposite end of the base. First and second pairs of locking recesses are molded into the carrying case at opposite ends of the lid. The pair of wheels and the pair of locking feet on the base of a first carrying case are sized and positioned for receipt within respective ones of the first and second pairs of locking recesses that are formed in the lid of an adjacent carrying case. Accordingly, the first and adjacent carrying cases are stacked in close together interlocking engagement one above the other by which to prevent the first carrying case from shifting relative to the adjacent case.

A pull-out handle is recessed at an unobtrusive location within a cavity that is formed in the bottom of the base. The pull-out handle is slidable between retracted and axially extended positions to permit the case to be carried from place-to-place. In the event that is not desirable to use the pull-out handle, another handle is rotatably connected to the front of the carrying case and recessed at an unobtrusive location within a first pocket formed therein. A complementary pocket is located at the rear of the carrying case, such that when a first and adjacent carrying cases are positioned side-by-side, the respective first and complementary pockets thereof will be arranged in opposite facing alignment. Some of the rotatable handle recessed within the pocket at the front of the first carrying case is received in the complementary pocket at the rear of the adjacent carrying case, whereby the first and adjacent carrying cases are held in a close together interlocking engagement side-by-side one another. The close together interlocking relationship of one carrying case with a plurality of carrying cases that are arranged side-by-side and one on top of the other facilitates the stacking of such carrying cases in an array of rows and columns that is suitable for storage and/or shipment.

DETAILED DESCRIPTION

Figure 1:
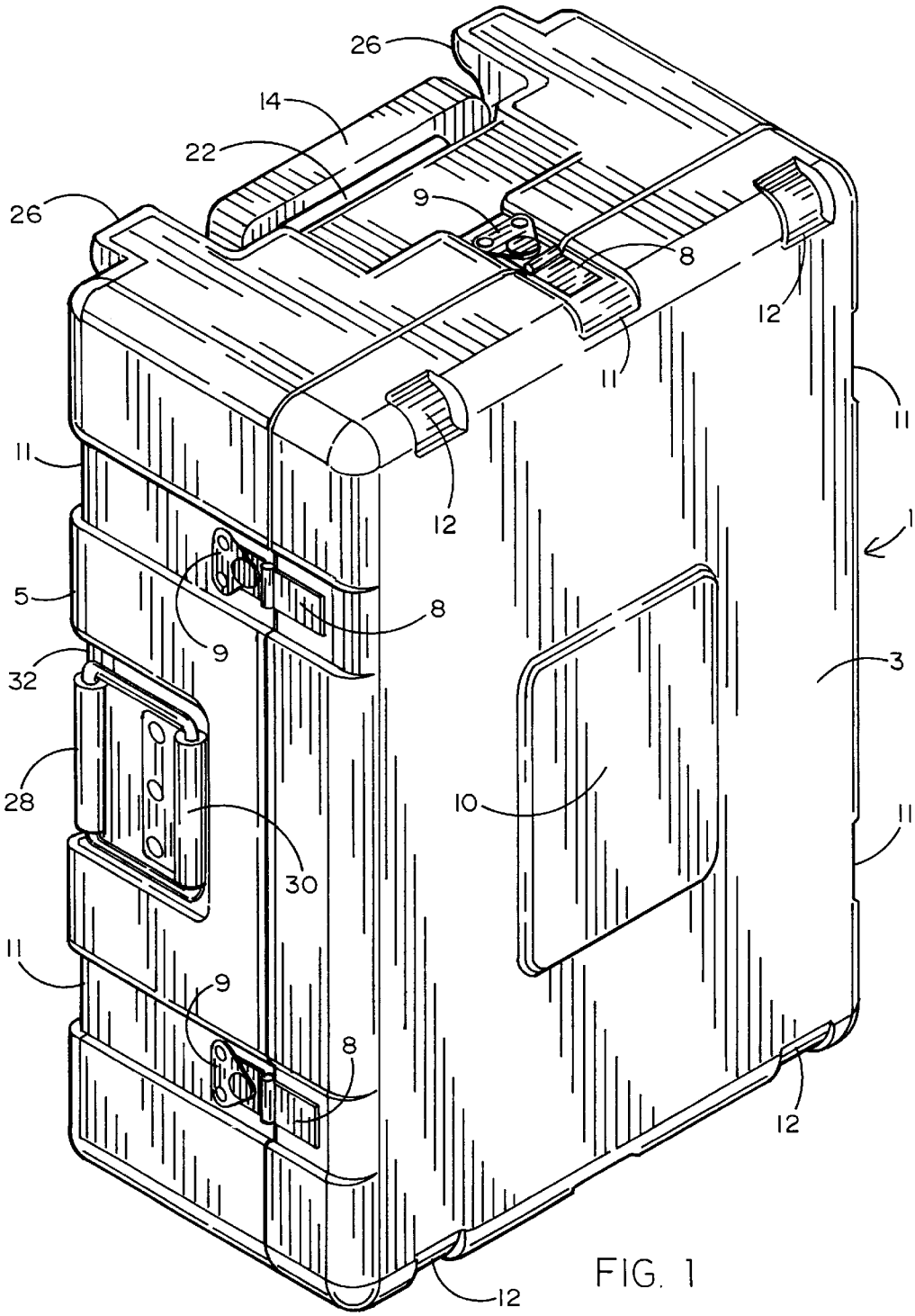
FIG. 1 shows the stackable interlocking carrying case for a portable computer which forms the present invention.

The stackable interlocking portable computer carrying case 1 which forms the present invention is initially described while referring concurrently to FIGS. 1–5 of the drawings. The carrying case 1 includes a lid 3 which is pivotally connected to a base 5 by means of a pair of hinges 7 (best shown in FIG. 2) that are attached to the rear of the case 1. The lid 3 is locked in position over top of the base 5 by means of a set of two-piece twist apart clasps 8 that are spaced around the front and sides of the case 1 at the intersection of the lid 3 with the base 5. By applying a twisting force to handles 9 of the twist apart clasps 8, the mating pieces of the clasps will be detached or uncoupled from one another. At this time, the lid 3 can be rotated around hinges 7 and moved upwardly from a closed to an open position relative to the base 5 to permit access to the contents (e.g. a portable computer) of carrying case 1. Each of the hinges 7 and clasps 8 for attaching the lid 3 to the base 5 are recessed within respective channels 11 formed in carrying case 1. Thus, the hinges 7 and clasps 8 will be positioned at an unobtrusive location so as not to interfere with an efficient, close together stacking arrangement of a plurality of carrying cases in a manner that will be described when referring to FIG. 6 and 7 hereinafter.

The carrying case 1 is preferably manufactured by means of a conventional vacuum forming process from a rugged, shock resistant (e.g. ABS) plastic material so as to be capable of transporting a portable computer (not shown). However, the computer which is to be received in and transported by the carrying case 1 forms no part of this invention. What is more, it is to be expressly understood that the carrying case 1 of this invention is not limited to transporting a portable computer and, therefore, other fragile equipment may also be transported from place-to-place within the case 1.

Figure 3:
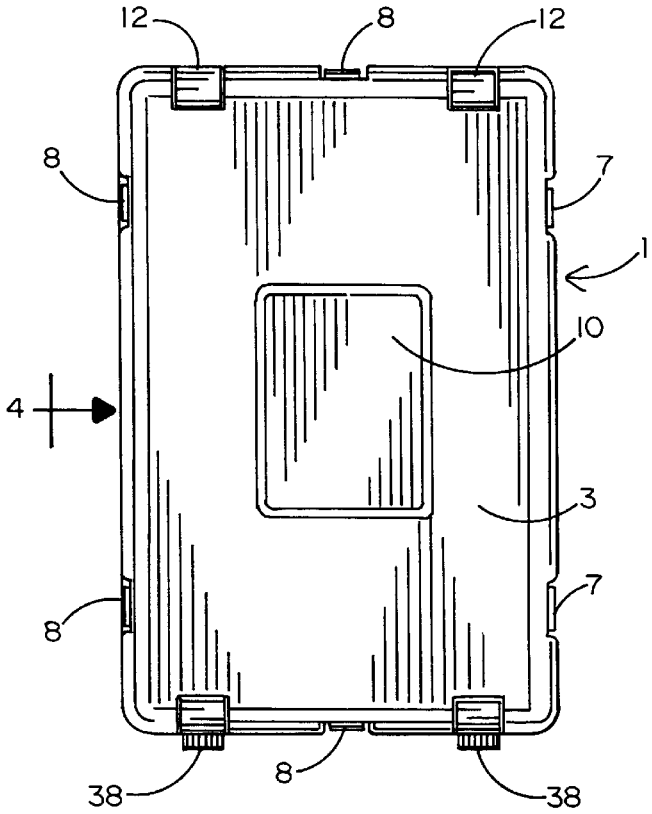
FIG. 3 shows the top of the carrying case.
Figure 6:
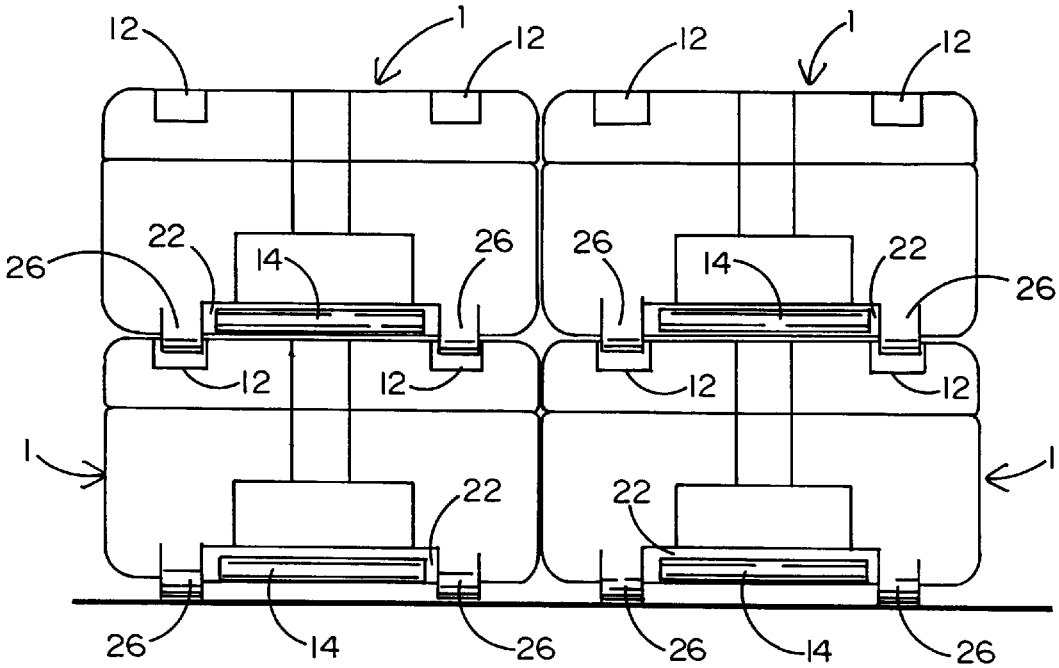
FIGS. 6 and 7 show a plurality of the interlocking carrying cases of this invention stacked in rows and columns side-by-side and one above the other to form an efficient close together array suitable for storage and/or shipment.
Figure 7:
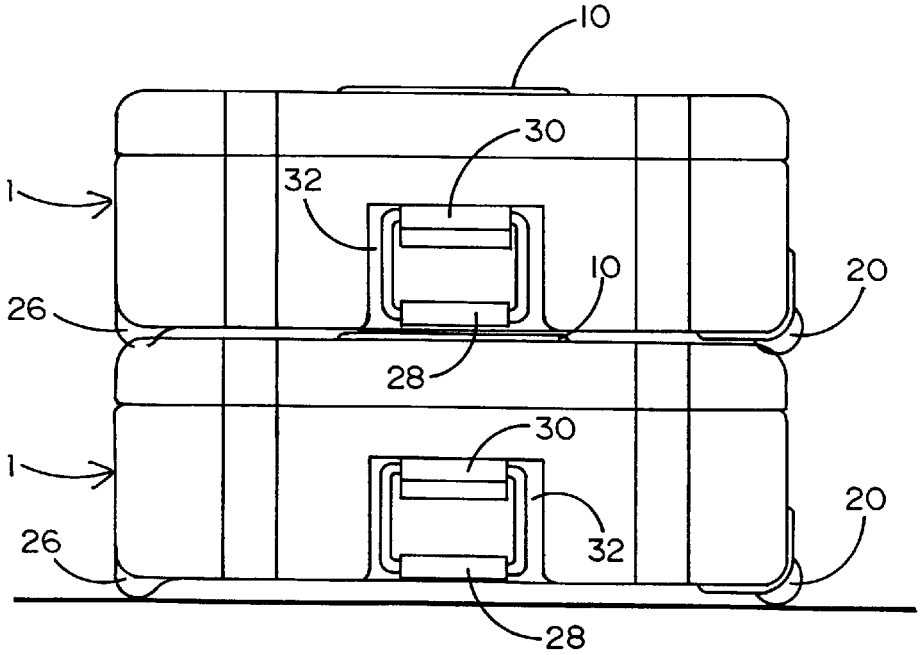

Located at the center of the lid 3 at the top of carrying case 1 is a raised stacking pad 10 (best shown in FIGS. 1 and 3). Although the stacking pad 10 is shown as being rectangular in shape, other shapes (e.g. circular) are also applicable herein. As an important feature of this invention, a set of (e.g. four) locking recesses are molded into the four corners of the lid 3 at the top of carrying case 1. More particularly, a first pair of locking recesses 12 are located in one edge of the lid 3, while a second pair of locking recesses 12 are located in the opposite edge of the lid. As is best shown in FIGS. 6 and 7, the pairs of locking recesses 12 are sized and positioned to receive therewithin respective pairs of wheels 20 and locking feet 26 from an adjacent carrying case to enable two or more of the carrying cases 1 to be stacked face-to-face in a column one above the other.

Figure 2:
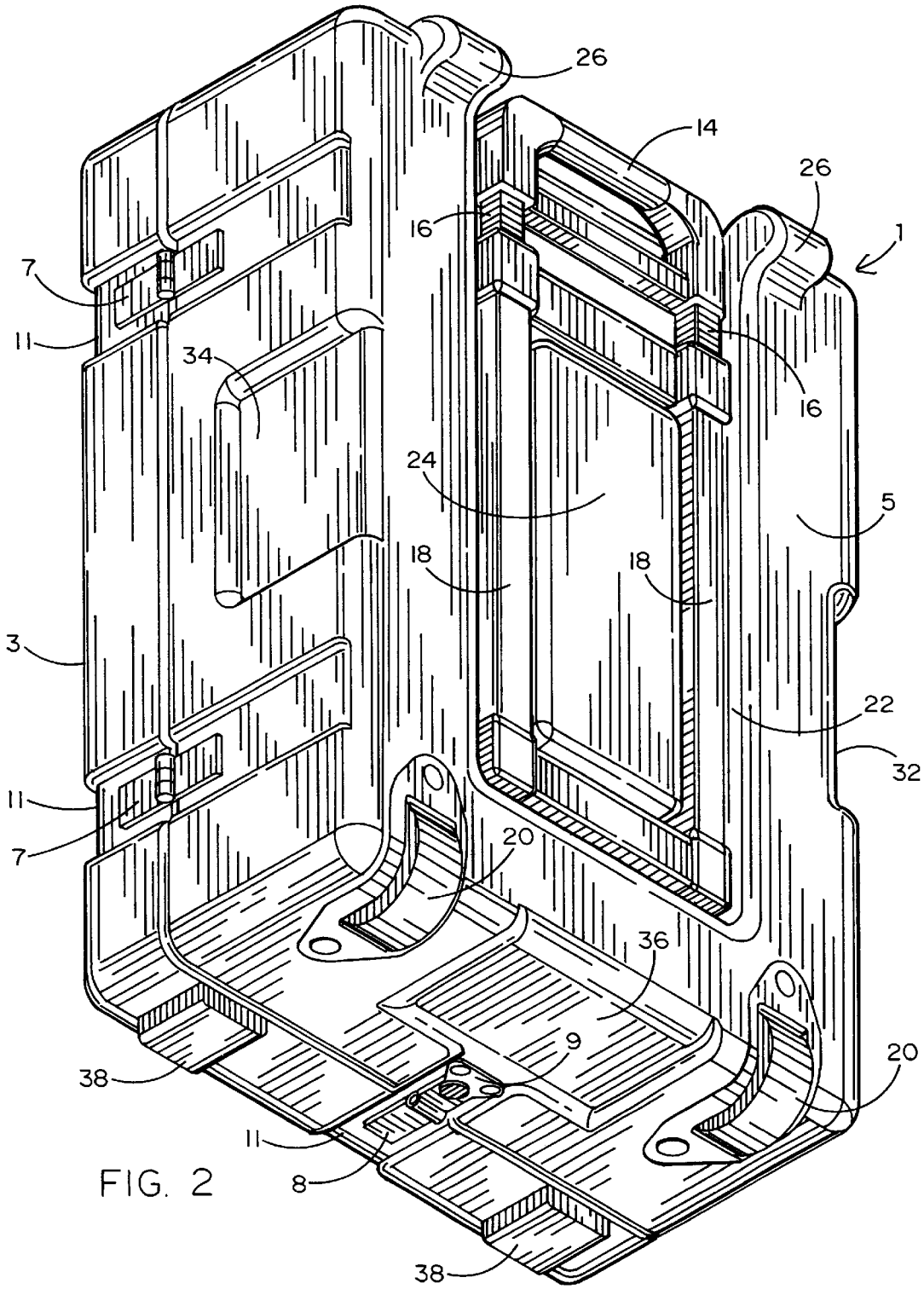
FIG. 2 shows the bottom, rear and a first side of the carrying case of FIG. 1.
Figure 5:
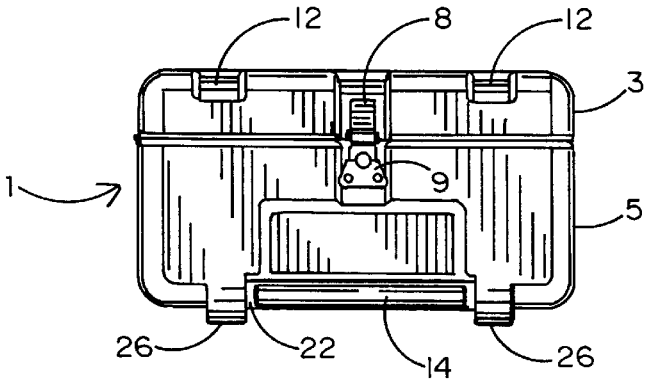
FIG. 5 shows the opposite side of the carrying case.

The base 5 of carrying case 1 is deeper than the lid 3 so as to be able to surround a portable computer, or the like. As is best shown in FIGS. 2 and 5, a retractable, pull-out handle 14 is carried by the base 5 at the bottom of the carrying case 1. The handle 14 includes a pair of rails 16 that are slidably received within a respective pair of spaced, parallel aligned hollow channels 18 that are affixed to the bottom of the case.

FIG. 2 shows the handle 14 in the retracted position with the rails 16 slidably received inwardly of their channels 18. When it is desirable to pull the carrying case 1 from place-to-place by means of the handle 14, the rails 16 are pulled outwardly from their channels 18 so that the handle will be moved to an axially extended position so as to project a convenient distance above a first side of the carrying case 1 (not shown) to suit the needs of a user.

To facilitate a close together, face-to-face stacking arrangement of carrying cases 1 in a column one above the other, the pair of hollow channels 18 that slidably receives the rails 16 of handle 14 are recessed within a longitudinally extending, generally U-shaped cavity 22 that is molded into the bottom of carrying case 1. The U-shaped cavity 22 in which the hollow channels 18 are located surrounds a raised stacking pad 24 at the center of the base 5 along the bottom of case 1. It may be appreciated that the channels 18 and the rails 16 slidably received therein are recessed in the cavity 22 so as to lie flush with the bottom of the carrying case 1 and the stacking pad 24. By virtue of the foregoing, the handle 14 is carried at an unobtrusive location within the cavity 22 formed along the bottom of the carrying case 1 so as not to interfere with a close together, face-to-face stacking of the carrying cases one above the other.

To enable the carrying case 1 to be pulled from place-to-place when the rails 16 of handle 14 are pulled outwardly from channels 18, a pair of wheels 20 are located in wheel wells formed in the base 5 at the interface of the bottom and a second side of carrying case 1. Positioned opposite the wheels 20 and located on the base 5 at the interface of the bottom and the second side of carrying case 1 (opposite the side past which the pull-out handle 14 is moved) is a pair of locking feet 26. Each locking foot 26 is a molded projection that extends outwardly from the base 5. As previously described and as is best shown in FIGS. 6 and 7, to create a stable column of carrying cases 1 stacked one above the other, the pair of wheels 20 from the base 5 of a first carrying case are received by a first pair of the locking recesses 12 at the lid 3 of an oppositely facing carrying case. In this same regard, the pair of locking feet 26 from the base 5 of the first carrying case 1 are received by the second pair of locking recesses 12 at the lid 3 of the oppositely facing case.

The receipt of the pairs of wheels 20 and locking feet 26 from the base 5 of one carrying case 1 within the corresponding pairs of locking recesses 12 at the lid 3 of an oppositely facing case preserves a face-to-face interlocking alignment of a column of carrying cases that are stacked one above the other. Accordingly, each of the carrying cases 1 is efficiently stacked in a space conserving column wherein the cases will not easily shift relative to one another, whereby the column is advantageously stabilized so as to avoid the possibility of tipping over, particularly when the column is exposed to shock during shipment and/or held in a storage facility.

The raised stacking pads 10 and 12 on the lid 3 and base 5 at the top and bottom of the carrying case 1 are axially aligned with one another and with the top and bottom stacking pads of the other carrying cases that are stacked one above the other in a column. Thus, the weight of a column of carrying case 1 can be concentrated along a generally vertical line that runs through the center of the column so as to maximize stability, especially when the column of cases is relatively tall.

Figure 4:
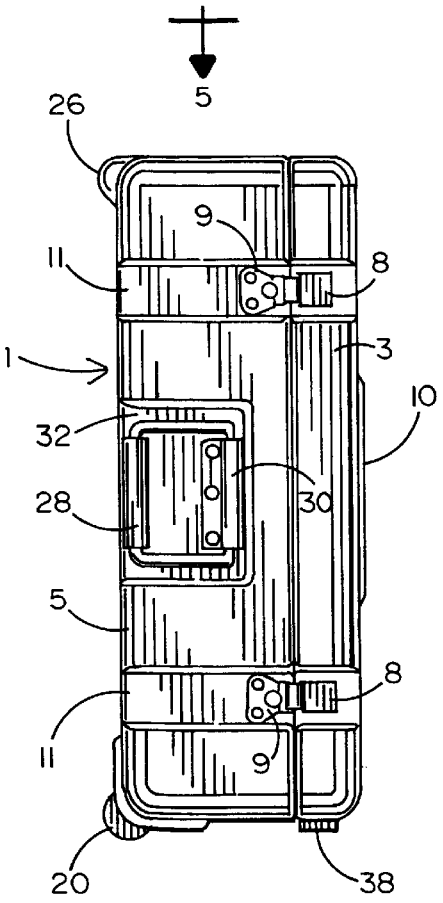
FIG. 4 shows the front of the carrying case.

The front of the carrying case 1 is shown in FIG. 4. To enable the carrying case 1 to be transported when it is not convenient or desirable to use the pull-handle 14 (of FIG. 2), an alternate handle 28 is also provided. The handle 28 is pivotally attached to the front of the carrying case 1 by means of a cylindrical coupling 30. The handle 28 and coupling 30 are recessed within a pocket 32 that is molded into the front of the carrying case 1. Thus, the handle 28 will be accessible at an unobtrusive location at the front of the carrying case and not interfere with the close together stacking arrangement of a plurality of carrying cases in one or more rows in the manner shown at FIGS. 6 and 7. When it is desirable to transport the carrying case 1 by using the handle 28, the handle is rotated around its cylindrical coupling 30 so as to move out of the pocket 32 to be grasped by a user.

The rear of the carrying case 1 is best shown in FIG. 2. A pocket 34 is molded into the rear of carrying case 1 so as to be aligned with the pocket 32 at the front of the carrying case within which the handle 28 (of FIGS. 1 and 4) is recessed. Thus, in the stacking arrangement of FIGS. 6 and 7, where a plurality of carrying cases are positioned in one or more rows, a portion of the rotatable handle 28 lying within the pocket 32 at the front of one carrying case 1 will be received within the opposing pocket 34 at the rear of an adjacent carrying case so as to reduce space consumption and thereby facilitate the close together, side-by-side stacking of the carrying cases 1 in an interlocking engagement with one another for storage in a warehouse or during shipment in a cargo hold.

The second side of the carrying case 1 is also best shown in FIG. 2. A pocket 36 is molded into the second side of carrying case 1 so as to be aligned with the pull-out handle 14 that is adapted to be axially extended past the opposite first side of the case. Thus, in the stacking arrangement of FIGS. 6 and 7, the top of pull-out handle 14 at the first side of the carrying case 1 will project outwardly therefrom for receipt by the pocket 36 at the opposite side of an adjacent carrying case so as to reduce space consumption and thereby further facilitate the close together, side-by-side stacking of a plurality of such cases in interlocking engagement with one another.

A pair of rests 38 are formed on the second side of carrying case 1 opposite the wheels 20. The rests 38 cooperate with the wheels 20 to keep the carrying case in an upright, vertical position when it is sitting at rest on a flat surface.

Turning now to FIGS. 6 and 7 of the drawings, there is shown a stable interlocking stacking arrangement where a plurality of carrying cases are stacked side-by-side and one above the other. By virtue of the pairs of wheels 20 and locking feet 26 on the base 5 of a first carrying case being received in respective pairs of locking recesses 12 that are formed in the lid 3 of an adjacent case lying thereunder, a relatively large number of carrying cases may be stacked one above the other while reducing the risk that the carrying cases will shift or slide over top one another. By additional virtue of a portion of each of the pull-out handle 14 and the rotatable handle 28 of the first carrying case 1 being received within respective pockets 36 and 34 at the side and rear of a pair of adjacent cases, a relatively large number of carrying cases may be stacked side-by-side one another. Moreover, because the hinges 7, clasps 8, and carrying handles 14 and 28 of a first carrying case are recessed within pockets that are aligned with opposing pockets of an adjacent carrying case, relatively long rows and columns of carrying cases may be stacked together so as to create an efficient, space conserving array that is suitable to be carried on a flat pallet and/or designated for storage or shipment. The top and bottom stacking pads 10 and 24 at the lid 3 and base 5 of each carrying case 1 help to support the weight and confine shock to the carrying case, itself, rather than permit such force to be otherwise transferred through the case and to the fragile contents therewithin.

I claim:

1. A plurality of carrying cases in which equipment is to be transported, a first one of said plurality of carrying cases adapted to be stacked in interlocking horizontal and vertical alignment with adjacent second and third ones of said plurality of carrying cases, each of said plurality of carrying cases comprising:

a body to enclose the equipment to be transported, said body including a bottom, a top that is movable between open and closed positions relative to said bottom, a front, a back and a pair of opposing sides;

a pair of wheels rotatably coupled to and projecting downwardly from one end of the bottom of said body;

a pair of feet fixedly connected to and projecting downwardly/from the opposite end of the bottom of said body;

a first pair of cavities formed at one end of the top of said body;

a second pair of cavities formed at the opposite end of the top of said body;

a pull-out handle for transporting said carrying case adapted to be moved between axially extended and retracted positions relative to the front of said body from a recess formed in the bottom of said body between said pairs of wheels and feet;

a rotatable handle for transporting said carrying case pivotally connected to one of said pair of opposing sides of said body; and a rotatable handle receiving pocket formed in the opposite one of said pair of opposing sides of said body, said pair of wheels and said pair of feet projecting downwardly from opposite ends of the bottom of the body of said first carrying case being received within respective ones of said first and second pairs of cavities formed in opposite ends of the top of said adjacent second carrying case positioned under said first carrying case and said rotatable handle connected to one side of the body of said first carrying case being received within the rotatable handle receiving pocket formed in the opposite side of said adjacent third carrying case positioned alongside said first carrying case, whereby said first and said adjacent second and third ones of said plurality of carrying cases are arranged in horizontal and vertical interlocking alignment with one another to prevent said first carrying case from shifting relative to said adjacent second and third carrying cases.

2. The plurality of carrying cases recited in claim 1, wherein each of said plurality of carrying cases also comprises a pair of raised weight supporting stacking pads projecting outwardly and in opposite directions from the top and bottom of the body thereof, such that the raised stacking pad on the bottom of the body of said first carrying case is arranged in opposite facing alignment with the raised staking pad on the top of the body of said adjacent second carrying case when said first and adjacent second carrying cases are stacked in interlocking vertical alignment one above the other.

3. The plurality of carrying cases recited in claim 1, wherein each of said plurality of carrying cases also includes at least one hinge located on one of said pair of opposing sides of said body thereof by which to enable said top to be moved between said open and closed positions relative to said bottom, said at least one hinge being recessed within a channel formed in the said one of said pair of sides.

4. The plurality of carrying cases recited in claim 1, wherein each of said plurality of carrying cases also includes a pull-out handle receiving pocket formed in the back of the body thereof, the pull-out handle of said first carrying case being received within the pull-out handle receiving pocket formed in the back of an adjacent fourth one of said plurality of carrying cases positioned in front of said first carrying case when said pull-out handle is in the retracted position, whereby said first and said adjacent second, third and fourth ones of said plurality of carrying cases are stacked in interlocking horizontal and vertical alignment with one another.

* * * * *